United States Patent [19]

Shekleton

[11] Patent Number: 4,967,562

[45] Date of Patent: Nov. 6, 1990

[54] TURBINE ENGINE WITH HIGH EFFICIENCY FUEL ATOMIZATION

[75] Inventor: Jack R. Shekleton, San Diego, Calif.

[73] Assignee: Sundstrand Corporation, Rockford, Ill.

[21] Appl. No.: 283,081

[22] Filed: Dec. 12, 1988

[51] Int. Cl.[5] ..... F23R 3/32

[52] U.S. Cl. ..... 60/738; 60/742; 60/743; 60/39.36

[58] Field of Search ..... 60/743, 737, 738, 39.36, 60/39.826, 742; 239/424, 533.12; 123/531

[56] References Cited

U.S. PATENT DOCUMENTS

| | | | |
|---|---|---|---|
| 1,052,588 | 2/1913 | Janicki . | |
| 2,705,868 | 4/1955 | Forman | 60/738 |
| 2,706,520 | 4/1955 | Chandler . | |
| 2,929,209 | 3/1960 | Schirmer . | |
| 3,009,320 | 11/1961 | Paiement . | |
| 3,026,675 | 3/1962 | Vesper et al. | 60/742 |
| 3,142,961 | 8/1964 | Carlisle | 60/743 |
| 3,353,351 | 11/1967 | Bill et al. | 60/743 |
| 3,355,884 | 12/1967 | Poucher et al. | 60/743 |
| 3,469,394 | 9/1969 | Beheim . | |
| 3,973,390 | 8/1976 | Jeroszko | 60/743 |
| 3,977,186 | 8/1976 | Arvin et al. . | |
| 4,036,582 | 7/1977 | Fehler et al. . | |
| 4,157,012 | 6/1979 | DuBell | 60/742 |
| 4,798,190 | 1/1989 | Vaznaian et al. | 123/531 |

*Primary Examiner*—Louis J. Casaregola
*Assistant Examiner*—Timothy S. Thorpe
*Attorney, Agent, or Firm*—Wood,Phillips,Mason,Recktenwald & VanSanten

[57] ABSTRACT

Excellent fuel atomization in a turbine engine may be obtained with fuel injectors 46, 47 including elongated, laminar discharge orifices 72, 100 and impingement surfaces 76, 102 disposed in the path of fuel 78, 106 being discharged through the discharge orifices 72, 100. Preferably, the fuel 78, 106 is discharged as a flat spray generally tangentially to the annular combustion space 40 of an annular combustor 26.

11 Claims, 2 Drawing Sheets

TURBINE ENGINE WITH HIGH EFFICIENCY FUEL ATOMIZATION

FIELD OF THE INVENTION

This invention relates to gas turbine engines, and more particularly, to gas turbine engines provided with inexpensive, high efficiency fuel atomizing fuel injectors to enhance reliability.

BACKGROUND OF THE INVENTION

In relatively small turbine engines in airborne environments, fuel flows at high altitudes, particularly during starting, are frequently quite low. Consequently, fuel injectors requiring high fuel pressures are commonly used to achieve pressure atomization of the fuel. However at low turbine speeds, it is difficult with available fuel pumps to generate the necessary fuel pressure. Further at such low speeds, the compressor of the turbine will not be delivering a large volume of compressed air and the atomization assist resulting from air blast atomization of fuel is unavailable. By way of example, in a typical worst case, the pressure drop across the combustor is about one inch of water which ordinarily is insufficient to provide acceptable fuel atomization.

To meet these difficulties, conventional injectors have extremely small orifices to provide the desired atomization making them precision formed parts. They are thus costly to manufacture. At the same time, because of the very small orifices employed, they are prone to plugging, a factor that clearly detracts from reliability. Where swirl pressure atomizing fuel injectors are used, with viscous fuels, high losses occur which reduce atomization efficiency and atomization is frequently unsatisfactory. In addition, the effects of the relatively small scale of these engines and their components reduce fuel atomization effectiveness.

The present invention is directed to overcoming one or more of the above problems.

SUMMARY OF THE INVENTION

It is the principal object of the invention to provide a new and improved turbine engine. More specifically, it is an object of the invention to provide a new and improved fuel injection system for a turbine engine which provides excellent fuel atomization adequate to provide reliable high altitude starting and operation and which may be manufactured inexpensively.

According to one facet of the invention, an exemplary embodiment of a gas turbine engine made according to the invention includes a rotary compressor and a turbine wheel coupled to the compressor to drive the same. An annular nozzle is proximate the turbine wheel for directing gases of combustion at the turbine wheel and an annular combustor defining an annular combustion space is disposed about the turbine wheel and in fluid communication with both the compressor and the nozzle. The combustor receives fuel from a source and air from the compressor and combusts the same to generate the gases of combustion. A plurality of fuel injectors are provided at circumferentially spaced locations about the combustor and at least one of the fuel injectors has two discharge orifices. The system includes fuel supply means for the fuel injectors including means for independently controlling the flow of fuel to at least one of the two discharge orifices of the one fuel injector.

In a highly preferred embodiment of the invention, the fuel supply means includes a first valve for controlling flow to one discharge orifice and a second valve for controlling flow to the other of the two discharge orifices of the one fuel injector.

The invention contemplates the provision of a fuel impingement surface defining means within the combustor and in the path of fuel discharged by the one fuel injector through either of the two discharge orifices.

The fuel impingement surface defining means is oriented so as to cause fuel impinging thereon to be sprayed within the combustion space in a generally tangential direction.

Preferably, the fuel impingement surface defining means constitutes a single impingement surface and in a highly preferred embodiment, such surface is defined by a single plate. In a highly preferred embodiment, one of the two discharge orifices is a laminar orifice having a length several times its width.

Other objects and advantages will become apparent from the following specification taken in connection with the accompanying drawings.

DESCRIPTION OF THE PREFERRED EMBODIMENTS

Figure 1:
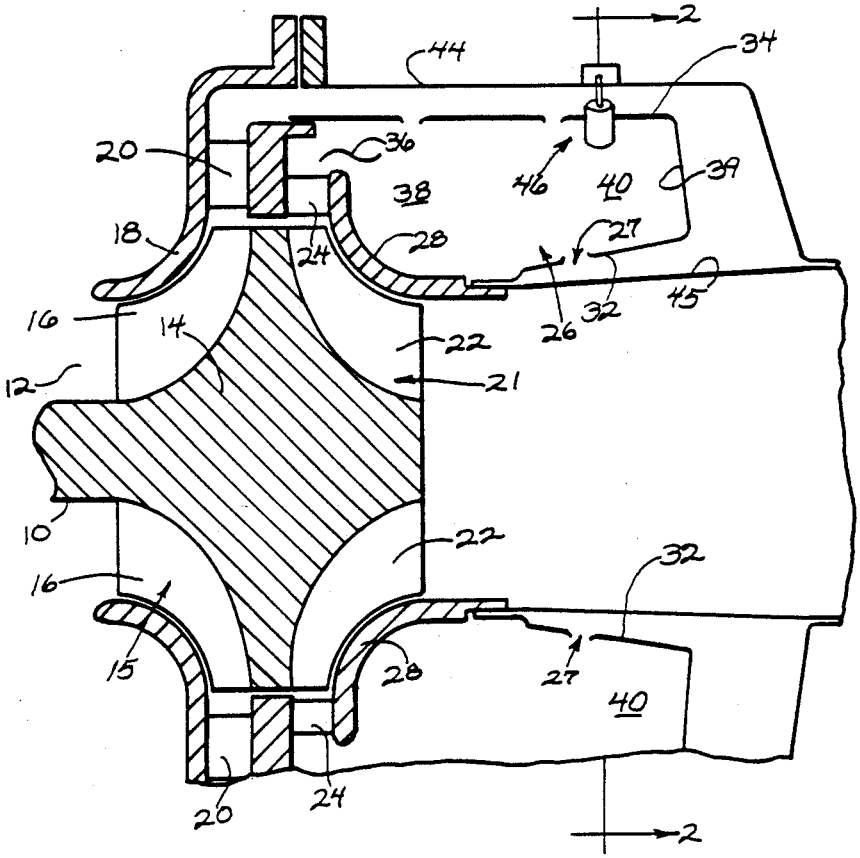
FIG. 1 is a somewhat schematic, sectional view of a gas turbine engine made according to the invention.

An exemplary embodiment of a gas turbine made according to the invention is illustrated in the drawings in the form of a radial flow, air breathing gas turbine. However, the invention is not limited to radial flow turbines and may have applicability to any form of air breathing turbine having an annular combustor.

The turbine includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a compressor section, generally designated 15, including a plurality of compressor blades 16 adjacent the inlet 12. A compressor shroud 18 is provided in adjacency thereto and just radially outwardly of the radially outer extremities of the compressor blades 16 is a conventional diffuser 20.

Oppositely of the compressor blades 16, the rotor 14 includes a turbine wheel, generally designated 21, including a plurality of turbine blades 22. Just radially outwardly of the turbine blades 22 is an annular nozzle 24 which is adapted to receive hot gases of combustion along with a dilution air, from an annular combustor, generally designated 26. The compressor 15 including the blades 16, the shroud 18, and the diffuser 20 delivers compressed air to the annular combustor 26, and via dilution air passages 27, to the nozzle 24 along with the gases of combustion. That is to say, hot gases of combustion from the combustor 26 are directed via the nozzle 24 against the blades 22 to cause rotation of the rotor 14 and thus the shaft 10. The latter may be, of course, coupled to some sort of apparatus requiring the performance of useful work.

A turbine blade shroud 28 is interfitted with the combustor 26 to close off the flow path from the nozzle 24 and confine the expanding gas to the area of the turbine blades 22. The combustor 26 has a generally cylindrical inner wall 32, and a generally cylindrical outer wall 34. The two are concentric with each other and with the rotational axis of the shaft 10 and merge to a necked down area 36 which serves as an outlet from an interior annulus 38 defined by the space between the walls 32 and 34 of the combustor 26. The outlet 36 extends to the nozzle 24. A third wall 39, generally concentric with the walls 32 and 34, extends generally radially to interconnect the walls 32 and 34 and to further define the annulus 38.

Opposite of the outlet 36 and adjacent the wall 39, the interior annulus 38 of the combustor includes a primary combustion zone 40 in which the burning of fuel primarily occurs. The primary combustion zone 40 is an annulus or annular space defined by the generally radially inner wall 32, the generally radial outer wall 34, and the radial wall 39. Other combustion may, in some instances, occur downstream from the primary combustion zone 40 in the direction of the outlet 36. As mentioned earlier, provision is made for the injection of dilution air through the passages 27 into the combustor 26 to cool the gases of combustion to a temperature suitable for application to the turbine blades via the nozzle 24.

A further annular wall 44 is generally concentric to the walls 32 and 34 and is located radially outward of the latter. Similarly, an inner annular wall 45 inside the wall 32 is provided and together with the wall 44 provides a plenum surrounding the combustor 26.

Figure 2:
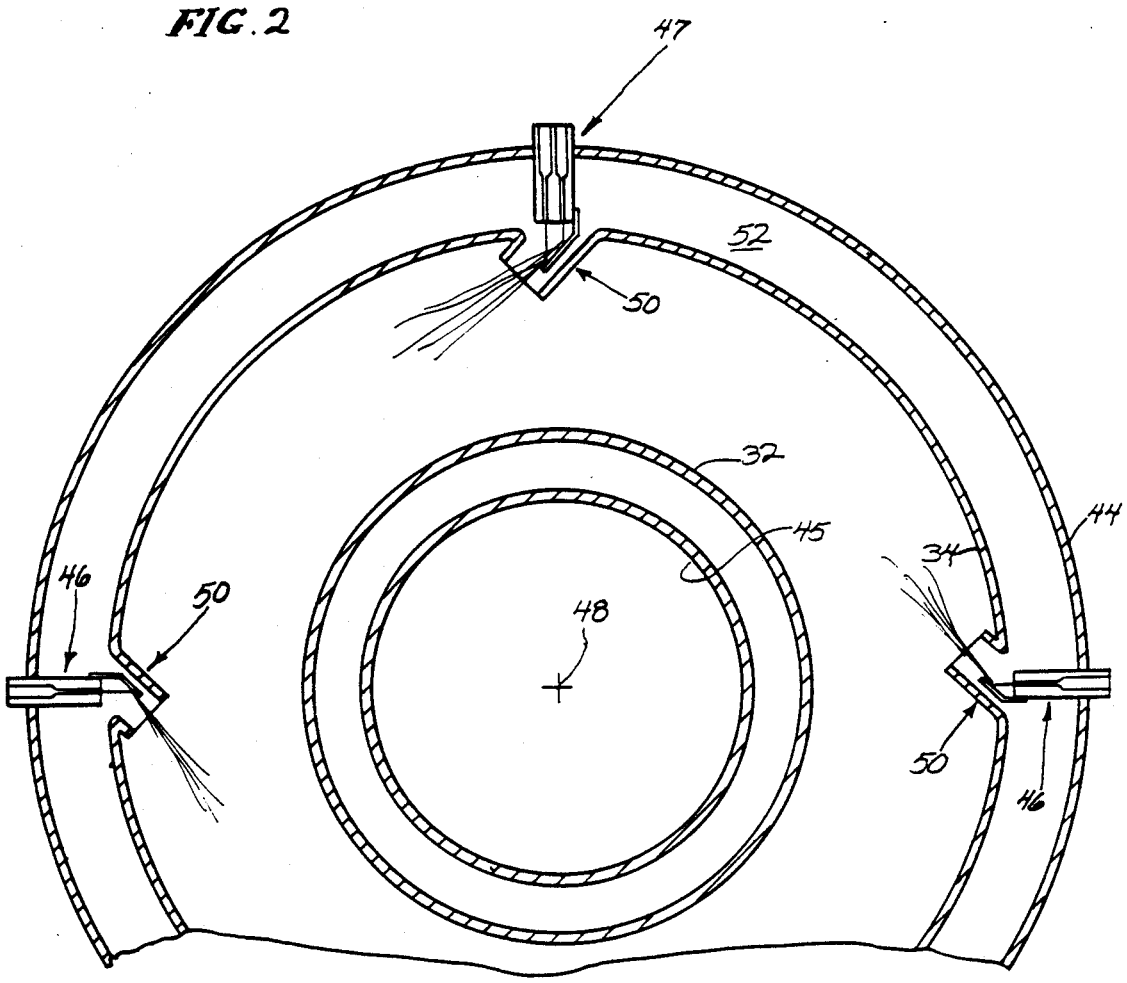
FIG. 2 is a section view taken approximately along the line 2—2 in FIG. 1.

Mounted on the wall 44, and extending through the wall 34, are main fuel injectors, generally designated 46 and a combination main and start fuel injector, generally designated 47. As seen in FIG. 2, according to a preferred embodiment of the invention, there are a plurality of the injectors 46, namely, three, located at 90° intervals about the axis of rotation of the shaft 10 which is designated by a point 48. At a location 90° between two of the injectors 46, the combination injector 47 is located.

Associated with each injector 46 and 47 is an air inlet port, generally designated 50. Each air inlet port 50 is in fluid communication with a space 52 between the walls 34 and 44 which serves as a plenum for compressed air received from the compressor 15 as mentioned previously.

The air inlet ports are elongated and generally cylindrical in configuration. The cylindrical axis of each is generally tangential to the combustion space defined by the walls 32 and 34 and generally speaking, the axes of each of the ports 50 will be in a single plane that is transverse to the rotational axis 48.

Figure 3:
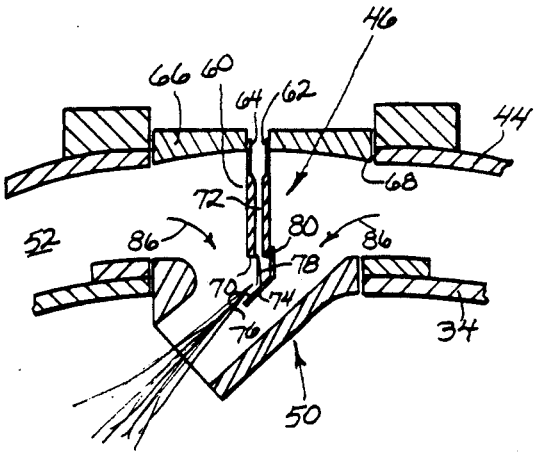
FIG. 3 is an enlarged, fragmentary sectional view of a main fuel injector.

As best seen in FIG. 3, each of the injectors 46 includes an elongated barrel 60 which is hollow as shown at 62. The barrel 60 may be received in an opening 64 in a removable mounting plate 66 suitably secured within an opening 68 in the wall 44.

The barrel 60 is of sufficient length so as to extend radially inwardly and across the manifold 52 to terminate in a discharge end 70 aligned with a corresponding one of the air inlet ports 50. The end 70 is generally transverse to a radius taken from the axis 48 but need not be.

Each barrel 60 terminates in an elongated, laminar discharge orifice 72. That is to say, the orifice 72 is such that for operating conditions contemplated, flow of fuel therethrough will be in the laminar regimen. Frequently this can be accomplished by making the orifice 72 a reduced diameter bore or passage. That is, the diameter of the orifice 72 is reduced from the diameter 62 of the main hollow part of the barrel 60. In addition, the orifice 72 should have a length that is several times its width, usually a ratio of at least five to one.

Located radially inwardly of the discharge orifice 72 is an impingement plate 74. The impingement plate 74 has a planar impingement surface 76 that faces the orifice 72 and which is at an acute angle with respect to the end 70 and which intersects the column of fuel 78 being discharged through the orifice 72. The plate 74 has two sections, one of which defines the aforementioned planar impingement surface 76. The other section is designated 80 and is at an obtuse angle to the section defined by the impingement surface 76. The section 80 is secured to the end 70 by any suitable means, for example, as by brazing.

The angular relation between the two sections of the plate 74 is such that the column of fuel 78, upon impinging on the surface 76 will be deflected and atomized and sprayed through the associated air inlet port 50 generally along the elongated axis of the same as can be seen in FIG. 3. That is to say, an atomized flat spray 84 of fuel will enter the combustion space defined by the walls 32 and 34 generally tangentially with respect thereto. Atomization of the spray will be enhanced by compressed air from the compressor 15 leaving the manifold 52 and entering the combustor as shown by arrows 86 in surrounding relation to the spray 84.

One very beneficial effect of the use of the laminar discharge orifice is that undesirable difficulties associated with so-called "manifold head" at high altitudes are virtually eliminated. As is well known, at high altitudes where low fuel flow rates are present, fuel pressure from a pump is relatively low with the consequence that the pressure differential due to the head of fuel in a manifold from top to bottom of the engine becomes significant. This in turn means that lower injectors receive fuel at high pressure than higher injectors. As an ultimate consequence, fuel injection is not uniform. The laminar orifices have a relatively high friction loss. As a consequence, the fuel pressure drop across such orifices is increased once again to the point where the pressure differential from top to bottom of the manifold again becomes negligible. However, where manifold head effects are not of concern, shorter orifices may be used.

Furthermore, because of the high pressure drop across the laminar orifices 72, the cross sectional area of their respective passages may be increased over conventional orifices without increasing fuel flow. The use of larger passages then provides a fuel flow path that is less prone to clogging.

Another substantial advantage of the invention is that proper atomization of the fuel is achieved by means of the relatively simple and inexpensive instrumentality in the form of the plate 74 and its impingement surface 76. This is in contrast to prior art pressure atomizing injectors wherein the fuel discharge orifices are responsible for atomization and therefore must be precisely formed at considerable expense.

Figure 4:
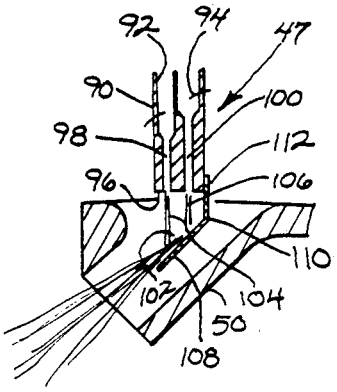
FIG. 4 is a view similar to FIG. 3 but of a combined start and main fuel injector.

A number of the same principals are employed in the combination injector 47 which is best illustrated in FIG. 4. The combination injector 47 includes a barrel 90 provided with two, side by side, enlarged bores 92 and 94. The bore 92 extends closer to the radially inner end 96 of the barrel 90 than does the bore 94 and both terminate in injection orifices 98 and 100 respectively. The orifice 100 is a so-called laminar orifice which means that flow therethrough will be in the laminar regimen. Typically this means that the length of the orifice 100 will be five or more times greater than its width. The orifice 98 may or may not be a similar laminar orifice as desired but in either event, both of the orifices 98 and 100 are of reduced diameter as compared to the bores 92 and 94 with which they are in fluid communication.

In fact, the bore 94 and laminar orifice 100 may be duplicates of the hollow 62 and orifice 72 in the main fuel injectors 46 and will be operated as a main fuel injector. The bore 92 and orifice 98 serve as a start fuel injector.

Like the injectors 46, the injector 47 includes a fuel impingement surface 102 disposed to be in the path of fuel columns 104 and 106 being discharged from the orifices 98 and 100 respectively. The impingement surface 102 serves to direct the fuel being discharged from the orifices 98 and 100 as a flat spray through the associated air inlet port 50 into the primary combustion zone 40.

In a preferred embodiment, the impingement surface 102 is defined by one section 108 of a bent plate 110 which is at an acute angle to the end 96 of the barrel 90. The section 108 is also at an obtuse angle to the other section 112 of the plate 110 which in turn is secured to the barrel 90 on a side thereof by any suitable means as, for example, by brazing.

An igniter 114 having an ignition tip 116 within the combustor annulus 38 is utilized. Preferably the tip 116 is in the path of a flat spray 118 emanating from the injector 47.

Figure 5:
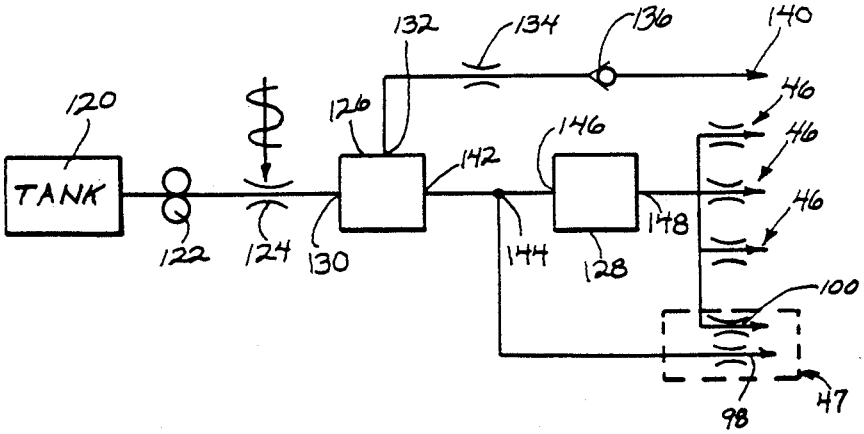
FIG. 5 is a schematic of a fuel flow control system.

FIG. 5 illustrates one highly preferred form of fuel system that may be employed in connection with the invention. A source of fuel such as a tank is shown at 120. A fuel pump 122 in fluid communication with the tank 120 pumps fuel under pressure to a main control valve 124.

The system includes a three-way valve 126 and a two-way valve 128. One port 130 of the three-way valve 126 is connected to the main control valve 124 to receive fuel under pressure therefrom. Another port 132 is connected via an orifice 134 and a check valve 136 to an overboard discharge port shown schematically at 140.

The third port 142 of the three-way valve 130 is connected to a tee 144. Another side of the tee 144 is connected to a port 146 on the two-way valve. The remaining port 148 for the two-way valve is connected to each of the main fuel injectors 46 as well as to the bore 94 and ultimately the orifice 100 in the injector 47. The system is completed by connecting the other leg of the tee 144 to the bore 92 and orifice 98 of the combination injector 47.

The three-way valve 126 is arranged such that, when energized, pressurized fuel from the tank 120, after suitable control on the flow has been exercised by the valve 124, will pass through the three-way valve 126 to the tee 144 while the line to the discharge port 140 will be blocked. Upon this occurrence, fuel will be directed to the start fuel discharge orifice 98 to inject fuel into the combustor 26 to start the engine.

At an appropriate point in the starting procedure, the valve 128 may be energized to allow the flow of fuel therethrough to each of the main fuel injectors 46 as well as to the main fuel injection orifice 100 to provide sustained operation of the turbine.

When operation of the engine is to be terminated, the valve 126 may be deenergized, at which time, the port 142 will be placed in fluid communication with the port 132 and the port 130 blocked. Residual pressure within the combustor will then act through the main fuel injectors 46 as well as the orifices 98 and 100 and drive fuel back through the three-way valve 126 and out of discharge port 140 to purge the fuel injectors and associated fuel lines to prevent any coking of fuel therein as a result of residual heat within the engine.

From the foregoing, it will be readily appreciated that a fuel system made according to the invention may be economically manufactured, is less prone to clogging and eliminates or minimizes altitude head problems. In addition, excellent atomization can be achieved both for a start fuel injector and for main fuel injectors through the use of impingement atomization. The combining of a main fuel injector and a start fuel injector in a single barrel simplifies overall construction and assembly of the apparatus.

According to one facet of the invention, the start fuel orifice 90 may be provided with fuel not only during start but during actual running which is to say it will be provided with fuel whenever the three-way valve 126 is energized. This feature minimizes cost and reliability problems associated with the providing of means for shutting off and purging a start injector separate from main fuel injectors after starting has been achieved. By continued operation of the start injection orifice 98 after injection of fuel from the main fuel injectors has been initiated, total combustion is enhanced to increase performance at low speeds.

The system is susceptible to operation whereby high fuel pressures may be utilized at low altitudes and low fuel pressure at high altitudes to optimize ignition. Whereas prior art systems would require very high fuel pressure with very small orifices at high altitudes, optimal fueling can be obtained in the present invention by utilizing both the orifices 98 and 100 at low altitude, solely the orifice 100 at moderate altitudes, and solely the orifice 98 at very high altitude, although this may require the use of a control system different from that illustrated in FIG. 5.

In addition, because the injectors of the present invention do not rely upon fuel swirlers to enhance atomization, the injection passageways allow a cleaner, more complete purge upon shut down and thereby minimize the possibility of fuel coking in residual heat. Thus, reliability is enhanced. Finally, the high turndown of injectors made according to the invention provides acceptable atomization at extremely low pressures and thus permit relatively simple altitude compensation schemes in connection with the fuel system.

I claim:

1. A gas turbine engine compressor comprising:

a rotary compressor;

a turbine wheel coupled to said compressor drive to same;

an annular nozzle proximate said turbine wheel for directing gases of combustion at said turbine wheel;

an annular combustor defining an annular combustion spaced disposed about said turbine wheel and in fluid communication with both said compressor and said nozzle, said combustor receiving fuel from a source and air from said compressor and combusting the same to generate said gases of combustion;

a plurality of fuel injectors at circumferentially spaced locations about said combustor, at least one of said fuel injectors having two discharge orifices, at least one of said fuel injectors having means for defining an elongated restricted passage of such size and length that flow of fuel through the passage will be laminar;

means for defining a fuel impingement surface within said combustor and in the path of fuel discharged by said one fuel injector through either of said two discharge orifices, said fuel impingement surface defining means as oriented so as to cause fuel impinging thereof to sprayed within said combustion space and a generally tangential direction; and fuel supply means for said fuel injectors including means for independently controlling the flow of fuel to at least one of said two discharge orifices of said one fuel injector.

2. The gas turbine engine of claim 1 wherein said fuel supply means including a first valve for controlling flow to said one discharge orifice and a second valve for controlling flow to the other of said two discharge orifices of said one fuel injector.

3. The gas turbine engine of claim 1 further including fuel impingement surface defining means within said combustor and in the path of fuel discharged by said one fuel injector through at least one of said two discharge orifices.

4. The gas turbine engine of claim 3 wherein said fuel impingement surface defining means are in the path of fuel discharged by either of said two discharge orifices of said one fuel injector.

5. The gas turbine engine of claim 4 wherein said fuel impingement surface defining means constitutes a single impingement surface.

6. The gas turbine engine of claim 1 wherein said elongated passage has a length several times its width.

7. A gas turbine engine comprising:

a rotary compressor;

a turbine wheel coupled to said compressor to drive the same;

an annular nozzle proximate said turbine wheel for directing gases of combustion at said turbine wheel;

an annular combustor defining an annular combustion space disposed about said turbine wheel and in fluid communication with both said compressor and said nozzle, said combustor receiving fuel from a source and air from said compressor and combusting the same to generate said gases of combustion;

a plurality of fuel injectors at circumferentially spaced locations about said combustor, at least one of said fuel injectors having two discharge orifices, at least one of said orifices having means for defining an elongated restricted passage of such size and length that flow of fuel through the passage will be laminar; and means defining an impingement surface within said combustor and spaced from said one orifice while in the path of fuel discharged from said one orifice and located so as to cause fuel discharged from said one orifice to enter said combustion space in a flat spray and generally tangential thereto.

8. The gas turbine engine of claim 7 wherein said impingement surface is a flat plate located radially inwardly of both said orifices.

9. The gas turbine engine of claim 7 further including a fuel flow control system including valve means whereby fuel may be discharged through one of said orifices and not the other.

10. A gas turbine engine comprising:

a rotary compressor:

a turbine wheel coupled to said compressor to the same;

an annular proximate said turbine wheel for directing gas of combustion at said turbine wheel;

an annular combustor defining an annular combustion space disposed about said turbine wheel and in fluid communication with both said compressor and said nozzle, said combustor receiving fuel from a source and air from said compressor and combusting the same to generate said gases of combustion;

a plurality of fuel injectors at circumferentially spaced locations about said combustion, at least one of said fuel injectors having two fuel discharge orifices, one of said orifices being a main fuel injection orifice and the other of said orifices being a start fuel injection, at least one of said orifices having means for defining an elongated restricted passage of such size and length that flow of fuel through the passage will be laminar;

means defining an impingement surface within said combustor and spaced from said one orifice while in the path of fuel discharged from said one orifice and located so as to cause fuel discharged from said one orifice to enter said combustion space in a flat spray and generally tangential thereto; and a fuel control system including at least two valves, one operable to control flow to said start orifice and the other operable to control flow to said main fuel orifice and the other of said injectors.

11. The gas turbine engine of claim 10 wherein said one valve is also operable to control flow to said main fuel orifice and said other injectors.

* * * * *